US008381822B2

(12) United States Patent
Hales et al.

(10) Patent No.: US 8,381,822 B2
(45) Date of Patent: Feb. 26, 2013

(54) MANAGING PRESSURIZED FLUID IN A DOWNHOLE TOOL

(75) Inventors: John H. Hales, Frisco, TX (US); John D. Burleson, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 338 days.

(21) Appl. No.: 12/617,447

(22) Filed: Nov. 12, 2009

(65) Prior Publication Data

US 2011/0108263 A1 May 12, 2011

(51) Int. Cl.
*E21B 43/119* (2006.01)

(52) U.S. Cl. ..... 166/377; 166/55.1; 166/297; 175/4.54

(58) Field of Classification Search ..... 166/55.1, 166/55, 63, 297, 377; 175/4.54, 4
See application file for complete search history.

(56) References Cited

U.S. PATENT DOCUMENTS 3,842,919 A * 10/1974 Dermott ..... 175/4.54
4,693,314 A 9/1987 Wesson et al.
4,907,655 A 3/1990 Hromas
5,044,388 A 9/1991 Barton et al.
6,588,508 B2 7/2003 Parrott et al.
6,702,017 B1 3/2004 Corrigan et al.
7,083,009 B2 8/2006 Paluch et al.
7,121,340 B2 10/2006 Grove et al.
7,861,784 B2 1/2011 Burleson et al.
2002/0033264 A1 3/2002 Parrott et al.
2008/0307951 A1 12/2008 Kaiser et al.

* cited by examiner

*Primary Examiner* — David Andrews
(74) *Attorney, Agent, or Firm* — Fish & Richardson P.C.

(57) ABSTRACT

A wellbore apparatus includes a connector sub assembly having a body, the body having a first end adapted to couple to a first perforating sub component and a second, axially opposed end adapted to couple to a second perforating sub component. The connector sub body defines a cavity proximate the second end of the connector sub body; and a flow path in fluid communication with the cavity and a location exterior to the wellbore apparatus. The apparatus includes a valve residing in the flow path and actuatable to block or allow fluid flow from the cavity, through the flow path, to the location exterior to the wellbore apparatus.

16 Claims, 5 Drawing Sheets

MANAGING PRESSURIZED FLUID IN A DOWNHOLE TOOL

TECHNICAL BACKGROUND

This disclosure relates to managing pressurized fluid from discharging one or more perforating devices in a wellbore.

BACKGROUND

Explosive devices are often used to create holes (i.e., perforations) in a wall of a wellbore so as to allow one or more hydrocarbon fluids to enter the wellbore from a subterranean zone. These devices, typically called perforating guns, contain one or more explosive charges designed to perforate the wall of the wellbore, including a casing and/or cement, so as to produce such fluids. Modern perforating guns may typically consist of a string of explosive devices connected by such other components as isolation subs, tandems, and box to pin connectors, to name but a few. In some instances, the string of perforating guns may be over 1000 feet long. Such strings allow for perforating the wellbore at multiple subterranean zones, each of which may produce one or more hydrocarbon fluids (e.g., oil, gas).

In some instances, spacer guns may be used within the string. Typically, the spacer guns contain no explosive charges but allow for a detonating signal to be transmitted to perforating guns connected lower or higher in the string. Upon receipt of the detonating signal (such as via an explosive train), the explosive charges within a particular perforating gun in the string are set off, thereby creating perforations in the wall of the wellbore. Setting off the explosive charge, however, may also trap a portion of explosive gases created by the detonation inside the perforating sub-assembly. For example, explosive gases may be generated by detonation of one or more components within the explosive train within the perforating string. Such explosive gases (all or a portion) may be purposefully trapped within one or more spacer guns. In addition, other pressurized fluids (e.g., gas, liquid, or a combination thereof) may build up in a spacer gun within a perforating string independent of explosive gases. For instance, hydrostatic, or wellbore, pressure may increase within the spacer gun during normal operation of the perforating string.

The explosive gases may remain in the perforating sub-assembly until the string is retrieved from the wellbore and brought to the terranean surface. Such explosive gases may be under extremely high pressure, which may need to be relieved when the string reaches the terranean surface. Relieving the pressure of the explosive gases in the perforating sub-assembly is often difficult if not dangerous. For example, wellsite personnel charged with releasing such pressure often do not know the extent of the pressure built up in the perforating sub-assembly. Further, if the pressure is in excess of maximum design limits of the perforating gun, damage to the perforating sub-assembly and/or injury to such personnel may occur as attempts to relieve the pressure ensue.

DETAILED DESCRIPTION

Figure 1:
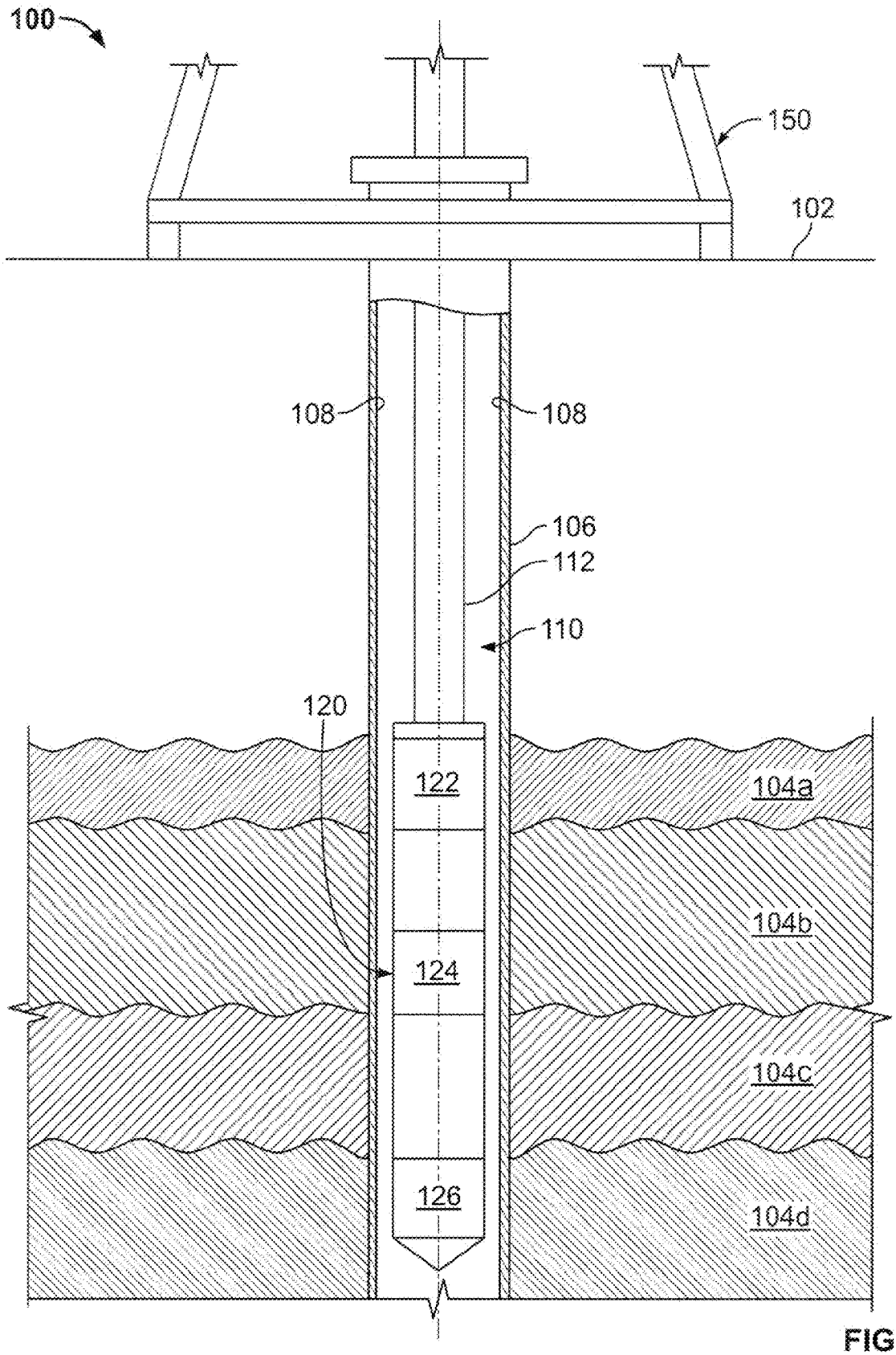
FIG. 1 illustrates a perforating sub-assembly in accordance with the present disclosure.

In one general embodiment, a wellbore apparatus includes a connector sub assembly having a body, the body having a first end adapted to couple to a first perforating sub component and a second, axially opposed end adapted to couple to a second perforating sub component. The connector sub body defines a cavity proximate the second end of the connector sub body; and a flow path in fluid communication with the cavity and a location exterior to the wellbore apparatus. The apparatus includes a valve residing in the flow path and actuatable to block or allow fluid flow from the cavity, through the flow path, to the location exterior to the wellbore apparatus.

In another general embodiment, a method for relieving a pressurized fluid from a downhole tool includes withdrawing at least a portion of a downhole tool through a wellbore, the downhole tool including a connector sub assembly having a body. The body has a first end adapted to couple to a first perforating sub component and a second, axially opposed end adapted to couple to a second perforating sub component. The connector sub body defines a cavity proximate the second end of the isolation sub body, and a flow path in fluid communication with the cavity and a location exterior to the tool. The downhole tool includes a valve residing in the flow path. The method further includes actuating the valve to allow fluid flow from the cavity, through the flow path, to the location exterior to the tool.

In another general embodiment, a downhole tool system includes first and a second perforating guns coupled within the tool system; a chamber disposed within the tool system between the first and second perforating guns and operable to contain a pressurized fluid; first and second connector sub assemblies coupled to opposed ends of the chamber; and a valve disposed in one of the first or second connector sub assemblies and in fluid communication with the chamber, where the valve is operable to relieve the pressurized fluid from the chamber.

In one or more specific aspects of one or more general embodiments, the connector sub assembly may include an isolation sub assembly, where the body may be an isolation sub assembly body.

In one or more specific aspects of one or more general embodiments, the body may further define a firing pin bore proximate the first end of the connector sub body, and the wellbore apparatus may further include an explosive charge receptacle between the firing pin bore and the cavity. The explosive charge receptacle may be adapted to sealingly receive an explosive initiator charge.

In one or more specific aspects of one or more general embodiments, the flow path may be in fluid communication with a location proximate the first end. In one or more specific aspects of one or more general embodiments, the flow path may have an outlet on at least one of a lateral surface of the connector sub body and an end surface of the connector sub body.

In one or more specific aspects of one or more general embodiments, the first perforating sub component may include a perforating gun and the second perforating sub component may include a spacer gun.

In one or more specific aspects of one or more general embodiments, the cavity is in fluid communication with the spacer gun. In one or more specific aspects of one or more general embodiments, the cavity may contain explosive gases from initiating a detonation of one or both of the first and second perforating sub components.

In one or more specific aspects of one or more general embodiments, the valve may be actuatable to block or allow fluid flow from the cavity, through the flow path, to the location exterior to the wellbore apparatus when the first perforating sub component is at least partially decoupled from the connector sub assembly.

In one or more specific aspects of one or more general embodiments, the valve may be manually actuatable to allow fluid flow from the cavity, through the flow path, to the location exterior to the wellbore apparatus when the wellbore apparatus is at or adjacent to a terranean surface. In one or more specific aspects of one or more general embodiments, the valve may be one of a needle valve or drain valve.

In one or more specific aspects of one or more general embodiments, a method may further include the step of withdrawing the portion of the downhole tool through the wellbore to or adjacent a terranean surface. In one or more specific aspects of one or more general embodiments, actuating the valve to allow fluid flow from the cavity, through the flow path, to the location exterior to the tool may include: at least partially decoupling the first perforating sub component from the connector sub body; and uncovering a flow path outlet on a lateral surface of the connector sub body.

In one or more specific aspects of one or more general embodiments, decoupling the first perforating sub component from the connector sub body may include unthreading the first perforating sub component from the connector sub body.

In one or more specific aspects of one or more general embodiments, withdrawing at least a portion of a downhole tool through a wellbore includes withdrawing at least a portion of a downhole tool from a first location in a wellbore having a first wellbore pressure to a second location in the wellbore having a second wellbore pressure, the second pressure less than the first pressure; and actuating the valve to allow fluid flow from the cavity, through the flow path, to the location exterior to the tool comprises actuating the valve to allow fluid flow from the cavity relative to a difference between the second pressure and the first pressure.

In one or more specific aspects of one or more general embodiments, actuating the valve to allow fluid flow from the cavity, through the flow path, to the location exterior to the tool may include manually opening the valve to allow fluid flow from the cavity, through the flow path, to the location exterior to the tool.

In one or more specific aspects of one or more general embodiments, the valve may be one of a check valve or metering valve. In one or more specific aspects of one or more general embodiments, the chamber may include a spacer perforating gun disposed between the first and second perforating guns. In one or more specific aspects of one or more general embodiments, the first and second connector sub assemblies may include first and second isolation sub assemblies.

In one or more specific aspects of one or more general embodiments, each of the first and second isolation sub assemblies may include a firing pin bore proximate a first end of the isolation sub assembly; and an explosive charge receptacle between the firing pin bore and the chamber. The explosive charge receptacle may be adapted to sealingly receive an explosive initiator charge.

In one or more specific aspects of one or more general embodiments, wherein the valve may be disposed within a flow path through the connector sub assembly, the flow path in fluid communication with the chamber and a location exterior to the connector sub assembly.

Various embodiments of a perforating sub-assembly including one or more pressure-relief valves according to the present disclosure may include one or more of the following features. For example, the perforating sub-assembly may allow for pressurized fluid (e.g., explosive gases or other pressurized gases, fluids, or combination thereof) generated by discharging one or more perforating guns in the string and captured within the string to be relieved without disassembling all or most of the string at a terranean surface. The perforating sub-assembly may also increase the safety of well site personnel disassembling or partially disassembling the string. The perforating sub-assembly may also allow for easier disassembly of the string by relieving or reducing built up pressure in one or more components caused by the explosive gases. The perforating sub-assembly may also prevent or help prevent an undesirable underbalance condition in the wellbore shortly after discharging one or more perforating guns within the string.

Various embodiments of a perforating sub-assembly including one or more pressure-relief valves according to the present disclosure may also include one or more of the following features. For example, the perforating sub-assembly may allow for the built up pressure due to explosive gases to be relieved in a controlled manner. The perforating sub-assembly may also allow for the built up pressure to be manually relieved. In some instances, the perforating sub-assembly may allow for the pressure due to explosive gases to be relieved by partially decoupling one or more components within the string. Further, the perforating sub-assembly may allow for a continuous or semi-continuous bleed-off of the pressure as the string is removed from the wellbore to the terranean surface. In some cases, the perforating sub-assembly may bleed off the pressure relative to a wellbore pressure.

FIG. 1 illustrates a well system 100 receiving a perforating sub-assembly (or "perforating sub") 120 disposed in a subterranean wellbore 106 and extending from a terranean surface 102. The wellbore 106, as illustrated, is disposed through four or more subterranean zones 104. A drilling rig 150 is used to form the wellbore 106. The drilling rig 150 is located at the terranean surface 102 and supports a perforating string 112. The perforating string 112 is generally disposed through the wellbore 106 that has been drilled or formed through one or more subterranean zones, such as illustrated subterranean zones 104*a*-104*d*, as well as other zones. An annulus 110 is defined between the perforating string 112 and the wellbore 106. In some embodiments, at least a portion of the wellbore 106 may be cased. For example, well system 100 may include a casing 108 cemented in place within the wellbore 106. The casing 108 (e.g., steel, fiberglass, or other material, as appropriate) may extend through all or a portion of one or more of the subterranean zone 104. In some embodiments, for example, the casing 108 may be a series of casings having different diameters and extending various lengths downhole through the wellbore 106. In some embodiments, the casing 108 extends through the wellbore 106 adjacent one or more of the perforating guns 122 and 126, as well as other tools within the perforating sub 120.

Generally, subterranean zones 104*a*-104*d* may include a hydrocarbon (e.g., oil, gas) bearing formation, such as shale, sandstone, or coal, to name but a few examples. But the illustrated subterranean zones 104 may be non-hydrocarbon bearing formations or formations bearing little or undesirable hydrocarbon fluids (e.g., oils or gases). In some embodiments, one or more of the subterranean zones 104 may include a portion or all of one or multiple geological formations beneath the terranean surface 102.

As illustrated, the perforating sub 120 may be suspended from the perforating string 112. For instance, in some embodiments, the perforating sub 120 may be a tubing conveyed perforating (TCP) system, with the perforating sub 120, as well as other perforating sub-assemblies, suspended, raised, and/or lowered in and through the wellbore 106 by the perforating string 112 (i.e., threaded pipe). For example, the well system 100 may utilize a TCP arrangement to create certain wellbore conditions, such as, for example, an underbalanced condition (e.g., wellbore pressure less than formation pressure). For instance, TCP may be advantageous in creating a desirable underbalance condition such that perforations created by the perforating sub 120 may be cleaner and/or more susceptible to producing hydrocarbons from the subterranean zone 104.

TCP may also be utilized when extremely long perforating sub-assemblies are disposed within the wellbore 106, such as, for example, perforating sub-assemblies at or greater than 1000 feet long. This is because, in certain instances, the TCP technique may allow for the more efficient assembly of such long perforating sub-assemblies. The present disclosure contemplates perforating sub-assemblies of any length, including lengths greater than or less than 1000 feet. In certain instances, the underbalance condition created by detonating one or more perforating guns in a perforating sub-assembly of extensive length may became undesirable. For example, the underbalance condition may be too great, thereby leading to damage to the subterranean zone 104 (e.g., collapse of the wellbore 106, perforations, or other damage).

Alternatively, the perforating sub 120 may be suspended from or otherwise coupled to coiled tubing disposed through the wellbore 106 from the terranean surface 102. Further, some embodiments of the well system 100 may utilize wireline/slickline. In any event, reference to the perforating string 112 merely refers to one example technique and does not limit or exclude other similar or appropriate techniques.

In some embodiments, the perforating string 112 may be disposed through multiple subterranean zones and at multiple angles. Although FIG. 1 illustrates a substantially vertical wellbore 106, the present disclosure contemplates and includes a directionally-drilled wellbore and multiple types of directionally-drilled wellbores, such as high angle wellbores, horizontal wellbores, articulated wellbores, curved wellbores (e.g., a short, long, or other radius wellbore), or multilateral wellbores. In short, the wellbore 106 may be a vertical borehole or deviated borehole or may include varying sections of vertical and deviated boreholes.

FIG. 1 shows one configuration of the perforating sub 120 including perforating guns 122 and 126 and spacer gun 124. Although two perforating guns 122 and 126 are illustrated, the present disclosure contemplates that many perforating guns may be utilized or coupled within the perforating sub 120, such as, for example, hundreds of perforating guns. Thus, FIG. 1 may represent an embodiment of a perforating sub 120 including only two perforating guns 122 and 126 or a portion of a larger perforating assembly. Typically, one or both of the perforating guns 122 and 126 include explosive charges that, when detonated, create one or more holes within, for instance, the subterranean zones 104 and/or the casing 108. In some instances, the perforating guns 122 and 126 include shaped charges to create such holes. In creating such holes, hydrocarbon fluids (e.g., oil and/or gas) may flow from one or more subterranean zones 104 into the annulus 110 and produced to the terranean surface 102.

In some embodiments, one or more subterranean zones 104 may be undesirable to perforate into at a given time. For instance, subterranean zone 104*a* and 104*d* may bear oil and/or gas while zones 104*b* and 104*c* may bear no fluid or may bear an undesirable fluid (e.g., water). Alternatively, zones 104*a* and 104*d* may be initially scheduled for production while zones 104*b* and 104*c* may be scheduled for later production. In such instances, the perforating sub 120 may include a spacer gun 124 coupled within the string 120. Although illustrated as including one spacer gun 124, the perforating assembly 120 may include multiple spacer guns, and reference to the spacer gun 124 includes multiple spacer guns. Generally, the spacer gun 124 is a "blank" perforating gun, i.e., contains no explosive charge or charges, but may allow for a detonating signal to pass through to one or more perforating guns 122 and/or 126. In some instances, spacer guns such as spacer gun 124 are assembled within the perforating assembly 120 to be suspended within the wellbore 106 adjacent geologic formations such as subterranean zones 104*b* and/or 104*c*. In other words, spacer guns may be strategically placed so as to suspend adjacent formations in which perforating is unnecessary and/or undesirable.

The spacer gun 124 (or multiple spacer guns coupled within the perforating sub 120), may be utilized to trap or contain explosive gases resulting from detonating one or more perforating guns 122 and 126. For example, the explosive gases may result from the detonation of an explosive train (e.g., Primacord or other explosive train and/or detonation cord) disposed through the perforating assembly 120. Pressurized fluid, such as the explosive gases, may also be generated by a hydrostatic, or wellbore, pressure. Such pressurized fluid (e.g., gas, liquid, or a combination thereof) can, when not contained, create an undesirable underbalance condition within the wellbore 106 after the one or more perforating guns 122 and 126 are discharged. This underbalance condition may follow a surge condition, in which the pressure in the wellbore 106 quickly increases. By utilizing the spacer gun 124 to trap or contain such pressurized fluids (e.g., explosive gases), the surge and/or underbalance condition may be minimized and/or prevented. The trapped pressurized fluid, however, must be released from the spacer gun 124 (and other spacer guns in the perforating sub 120) during removal of the perforating sub 120 to the surface 102, or at the surface 102. Such release, as mentioned above, may have hazardous or injurious effects. The disclosed embodiments of the perforating sub 120, as explained in more detail below, may provide for a more efficient and less hazardous technique, device, and system for relieving the pressurized fluid from the spacer gun 124 or any other component of the perforating sub 120 containing such pressurized fluid.

Figure 2:
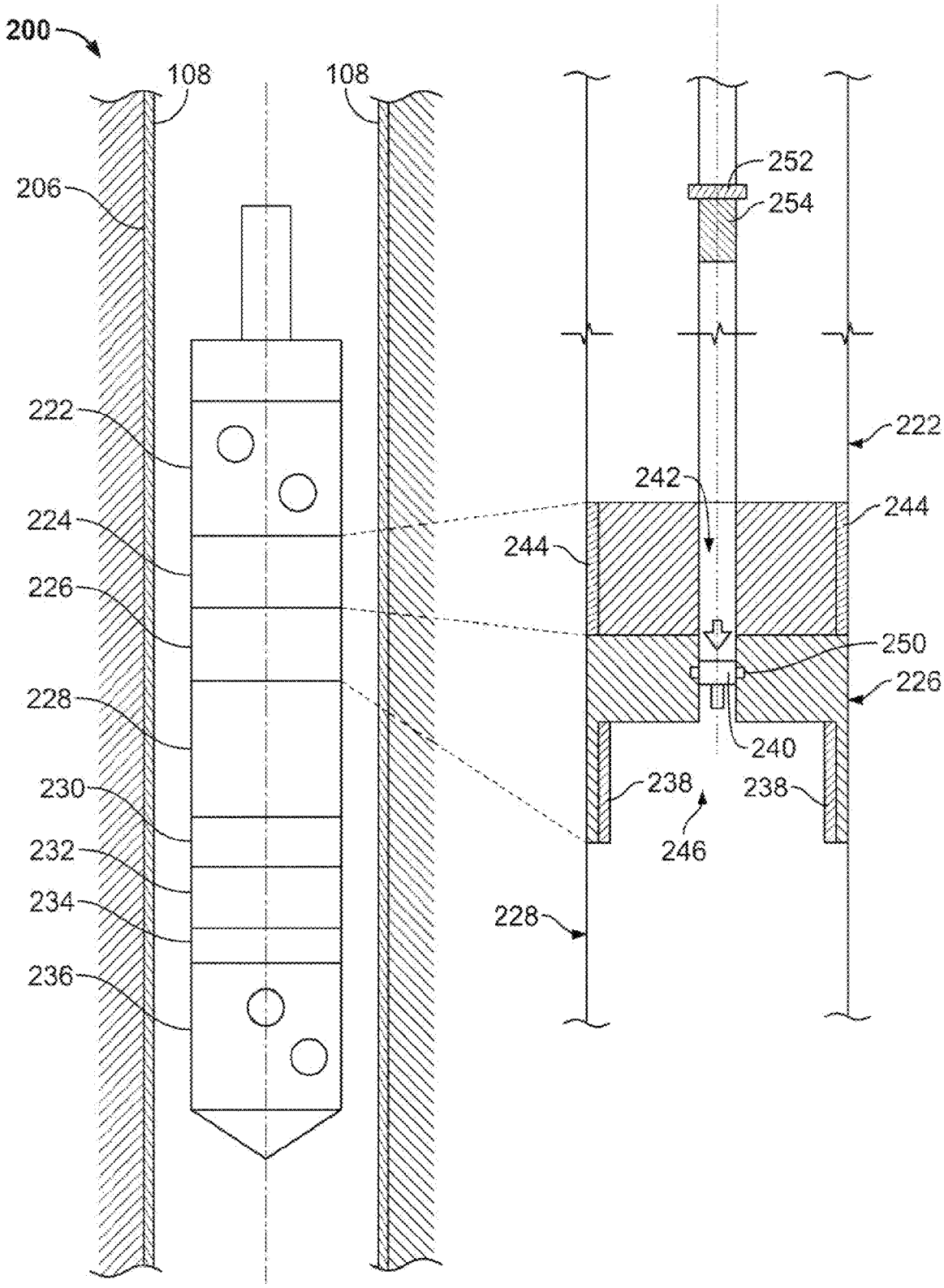
FIG. 2 illustrates one example embodiment of a perforating sub-assembly including two or more perforating guns and one or more spacer guns in accordance with the present disclosure.

FIG. 2 illustrates one example embodiment of a perforating sub 200 including one or more perforating guns 222 and 236 and one or more spacer guns 228 that can be used as the perforating sub 120. More specifically, the perforating sub 200 illustrates all or a portion of a perforating sub used to, for example, generate one or more holes or perforations in a wellbore casing. For example, the perforating sub 200 may be identical to or substantially similar to the perforating sub 120 disposed in the wellbore 106 as illustrated in FIG. 1. The illustrated perforating sub 200, generally, allows for the detonation of one or more perforating guns 222 and 236 while capturing or containing the explosive gases generated by such detonations (i.e., pressurized fluid) to be captured within the spacer gun 228. As noted above, capturing all or a portion of the pressurized fluid in the spacer gun 228 may prevent or help prevent an undesirable underbalance condition within the wellbore, such as wellbore 206.

In some embodiments, one or both of the perforating guns 222 and 236 may perforate a wall of the wellbore using shaped explosive charges. Alternatively, the guns 222 and/or 236 may perforate the wall of the wellbore using other explosive devices (e.g., bullets or other devices).

The illustrated perforating sub 200 includes, from an uphole end to a downhole end, the perforating gun 222, a connector module 224, an isolation sub 226, the spacer gun 228, a connector module 230, an isolation sub 232, a tandem 234, and the perforating gun 236. In other embodiments, however, the perforating sub 200 may include fewer or additional components, such as additional perforating guns, spacer guns, and/or other downhole tools. Perforating guns 222 and 236, typically, contain one or more explosive charges (such as shaped explosive charges) designed to creates holes in the wellbore 206, any casing adjacent the guns 222 and 236, and/or an adjacent subterranean zone. In particular, in some embodiments, the perforating guns 222 and 236 may be detonated via mechanical techniques, such as a firing head or other piston/pin device. In any event, the present disclosure contemplates that any detonation mechanism may be utilized to set off one or more of the perforating guns 222 and 236.

The perforating gun 222 is coupled to the connector module 224 at a downhole end of the gun 222. The connector module 224 (as well as the connector module 230) couples (threadingly or otherwise) adjacent components and, in some embodiments, allows for a detonating signal to be transmitted therethrough to downhole perforating guns, such as the perforating gun 236. In some embodiments, the connector module 224 may be a box-to-pin (BXP) connector that provides for mechanical coupling of the perforating gun 222 to the isolation sub 226. The BXP connector may include a female threaded end (i.e., the box connection) and a male threaded end (i.e., the pin connection). For instance, as illustrated, the connector module 224 includes threads 244 upon which the perforating gun 222 may be rotatably coupled to the connector module 224. Alternatively, other embodiments of the perforating sub 200 may use different coupling techniques to allow for a releasable connection between the perforating gun 222 and the connector module 224.

The isolation sub 226 is releasably coupled to the connector module 224 and the spacer gun 228. As illustrated, for example, the isolation sub 226 may be threadingly coupled to the spacer gun 228 by threads 238. Other coupling techniques may be used in other embodiments of the isolation sub 226, as appropriate. The illustrated isolation sub 226, typically, provides pressure isolation at an uphole end of the spacer gun 228, thereby preventing or substantially preventing a flow of pressurized fluid captured in the spacer gun 228 to, for example, other uphole components of the perforating sub 200.

The isolation sub 226, as illustrated, includes a sealed initiator 240 disposed in the bore 242. The sealed initiator 240, in some embodiments, may be used as an explosive feed through, thereby allowing a detonating signal to be transmitted therethrough while maintaining a pressure seal in the bore 242. For instance, in some embodiments, the sealed initiator 240 may hold up to 25,000 psi pressure on the downhole side of the initiator 240. The isolation sub 226 may also include one or more seals 250 disposed between the sealed initiator 240 and an inner diameter of the isolation sub 226 proximate the bore 242.

More specifically, in some embodiments, the isolation sub 226 and the sealed initiator 240 may be configured to transfer a detonation signal to one or more perforating guns located downhole within the perforating sub 200 (as an example of such a technique, see U.S. Pat. No. 6,675,896). For example, in some embodiments, the bore 242 houses a holder member (not shown), which may be made from a suitable material such as steel or aluminum. Confined within holder member is an explosive train that may include a booster, a detonation cord (e.g., RDX plastic cover Primacord or other detonation cord), an initiator booster, and a detonating charge.

In certain instances, the sealed initiator 240 may be disposed within the bore 242 above the holder member. Together, the sealed initiator 240, the booster, the detonator cord, and another booster may form an explosive train. Under normal operation, the isolation sub 226 may be used to transfer detonation from one detonation activated tool (e.g., perforating gun 222) to another detonation activated tool (e.g., perforating gun 236).

In certain embodiments, a detonation signal travels through the booster, the detonation cord, the initiator booster, and finally to the perforating gun 222. Upon detonation of the detonation cord, a large volume of fluid (e.g., gas) is generated that accumulates and pressurizes within the perforating sub 200, such as within the spacer gun 228. In some instances, some or all of the pressurized fluid may initiate or help initiate detonation of a explosive device lower in the sub 200. For example, the pressurized fluid may shear a shear pin 252 that, once sheared, propels a firing pin 254 through the bore 242 to impact the sealed initiator 240. Upon impact with sealed initiator 240, sealed initiator 240 detonates which in turn sends a detonation signal down the explosive train. A second booster may then transfer the detonation to, for example, the perforating gun 236. As such, the isolation sub 226 may transfer detonation from one detonation activated tool (e.g., perforating gun 222) to another detonation activated tool (e.g., perforating gun 236) by transferring detonation down an explosive train.

In certain embodiments, other techniques may be used to propel a firing pin from an uphole position to impact the sealed initiator 240. For example, an explosive train could alternatively terminate in other types of propellants including, but not limited to, a solid rocket propellant. As another alternative, an explosive train could utilize other external forces to shear a shear pin in order to propel a firing pin to impact the sealed initiator 240. In any event, the sealed initiator 240 should be impacted with sufficient velocity to create detonation.

The spacer gun 228 is coupled within the perforating sub 200 between the isolation sub 226 and the connector module 230. In the illustrated embodiment, the spacer gun 228 includes a cavity 246 where explosive gases (e.g., pressurized fluid) may be captured and contained after one or more of the perforating guns 222 and 236 are actuated. As explained more fully with reference to FIGS. 3A-B and 4, such captured pressurized fluid may be relieved from the spacer gun 228 at or adjacent the terranean surface or, alternatively, as the perforating sub 200 is removed from the wellbore 206.

The connector module 230 and the isolation sub 232 are coupled on the downhole end of the spacer gun 228 and, typically, provide for the same or substantially similar functionality on the downhole side of the spacer gun 228 as the connector module 224 and isolation sub 226 provide on the uphole side of the spacer gun 228. In some embodiments, the connector module 230 may also be a box-to-pin (BXP) connector that provides for mechanical coupling of the spacer gun 228 to the isolation sub 232. The isolation sub 232, for example, may provide pressure isolation at the downhole end of the spacer gun 228, thereby preventing (entirely or substantially) a flow of pressurized fluid captured in the spacer gun to, for example, other downhole components of the perforating sub 200. The isolation sub 232 may also include a sealed initiator disposed in a bore disposed axially in the isolation sub 232. The sealed initiator in the isolation sub 232 may be used as an explosive feed through, thereby allowing a detonating signal to be transmitted therethrough while maintaining a pressure seal in the bore.

The tandem 234 provides for a mechanical connection between the isolation sub 232 and the perforating gun 236. In some embodiments, the tandem 234 may be a pin-to-pin connector.

Figure 3A:
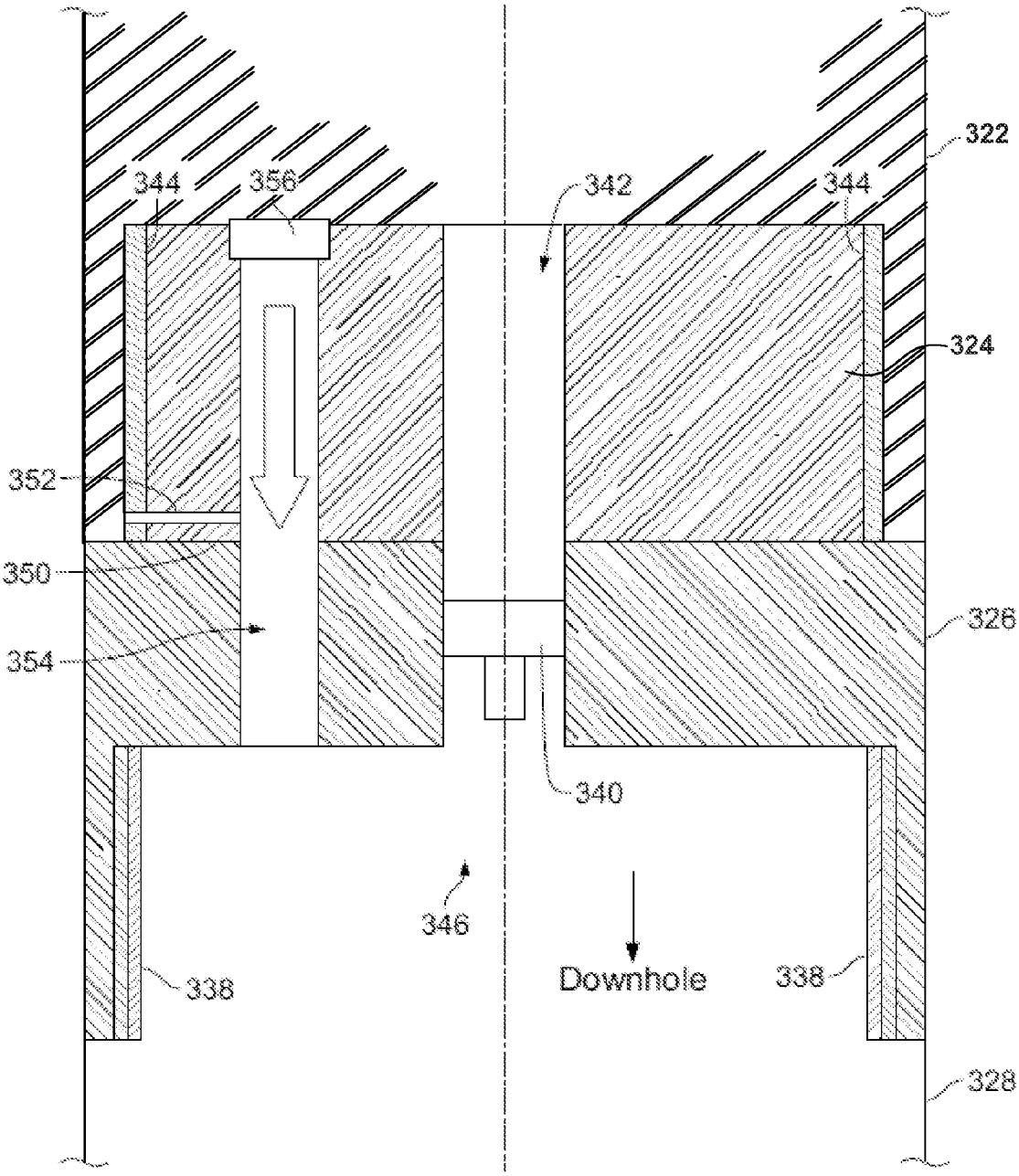
FIGS. 3A-B illustrate example embodiments of a valve used in a perforating sub-assembly to relieve a pressurized fluid captured in the string in accordance with the present disclosure.
Figure 3B:
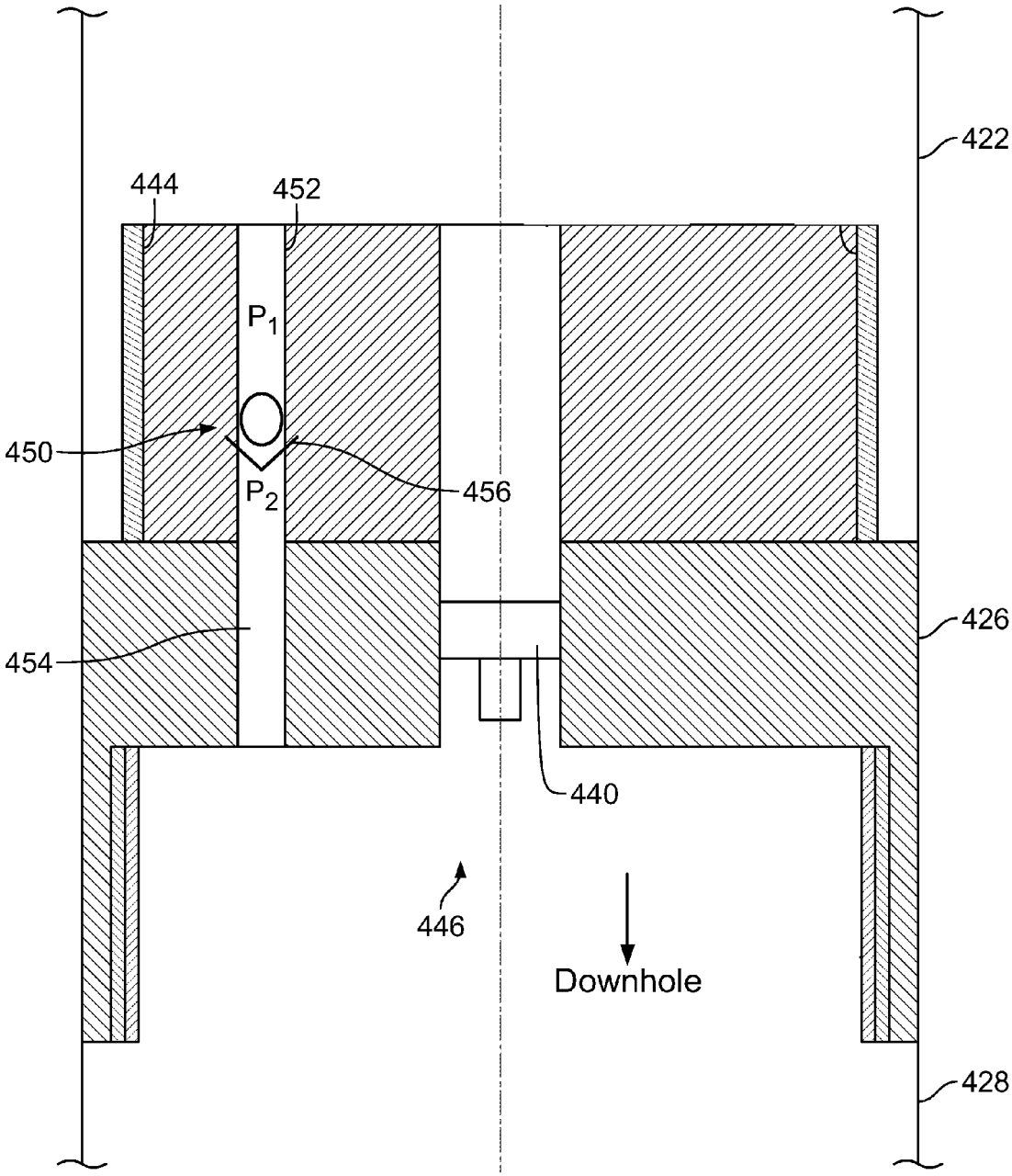

FIGS. 3A-B illustrate example embodiments of a valve used in a perforating sub to relieve a pressurized fluid captured in the string. FIG. 3A particularly, illustrates one embodiment including a connector module 324 coupled to an isolation sub 326, which is in turn coupled to a spacer gun 328. The connector module 324, isolation sub 326, and spacer gun 328 may be identical to or substantially similar to those same components illustrated above with respect to FIG. 2. As illustrated though, the isolation sub 326 includes a flowpath 354 disposed axially therethrough. The flowpath 354, in particular, is in fluid communication with a cavity 346 of the spacer gun 328 and enclosed at an opposite end by a cap 356. The cavity 346, upon detonation of one or more perforating guns within a perforating sub containing the spacer gun 346, may become filled with pressurized fluid (e.g., explosive gases). Such pressurized fluid may be captured and substantially contained in the spacer gun 328 at least partially by the isolation sub 326 and a sealed initiator 340, as explained more fully above.

As illustrated, the flowpath 354 extends from an upper surface (i.e., uphole end) of a body of the isolation sub 326 through the body of the isolation sub 326 and to a lower surface (i.e., downhole end). The flowpath 354 includes a valve 350 contained therein. As illustrated, the valve 350 sealingly closes the flowpath 354 and prevents (entirely or substantially) the pressurized fluid from escaping the cavity 346 of the spacer gun 328 in an uphole direction through the flowpath 354. The valve 350 also provides a device that can be operated to relieve the pressurized fluids contained in the cavity 346 at a specified time. In certain instances, the specified time can be once the perforating sub containing the spacer gun 328 is removed from a wellbore or removed off a wellsite, among other locations, the pressurized fluid may be released from the cavity 346 via the valve 350.

In some embodiments, the valve 350 may be configured as a bleeder valve. For example, the valve may be a needle valve including a port 352. The port 352 is in fluid communication with the flowpath 354 and extends to an exterior surface of the connector module 344. As illustrated, a perforating gun 322 is coupled to the connector module 324 and, as illustrated with a dashed line, covers the exterior surface of the connector module 324 when coupled (e.g., threadingly or otherwise connected) to the module 324. Thus, during operation of the perforating sub, including the perforating gun 322, connector module 324, isolation sub 326, and spacer gun 328, an outlet of the port 352 is covered, thereby preventing fluid communication between the flowpath 354 and the outlet. Further, in some embodiments, one or more gaskets and/or o-rings (not shown) may be disposed between the port 352 and a top of the isolation sub 326 to sealingly couple the perforating gun 322 and the connector module 324.

Upon raising the perforating sub to the surface or uphole within the wellbore, the perforating gun 322 may be decoupled (e.g., unscrewed) from the connector module 324. Upon decoupling of the gun 322 above the port 352, pressurized fluid from the cavity 346 may be controllably released through the port 352 and to the atmosphere and/or ambient air. For example, the valve 350 may be operated to allow for a controlled bleed-off of the pressurized fluid from the cavity 346, thereby minimizing any damaging effects of the pressurized fluid. For example, the valve 350 may be adjusted (e.g., slowly adjusted) to a partially open position and then be adjusted from the partially open position to a fully open position.

Turning now to FIG. 3B, another embodiment including a connector module 422 coupled to an isolation sub 426, which is in turn coupled to a spacer gun 428, is illustrated. The connector module 422, isolation sub 426, and spacer gun 428 may be identical to or substantially similar to those same components illustrated above with respect to FIG. 2. As illustrated, the isolation sub 426 include a flowpath 454 disposed axially therethrough. The flowpath 454, in particular, is in fluid communication with a cavity 446 of the spacer gun 428. The cavity 446, upon detonation of one or more perforating guns within a perforating sub containing the spacer gun 428, may become filled with pressurized fluid (e.g., explosive gases). Such pressurized fluid may be captured and substantially contained in the spacer gun 428 at least partially by the isolation sub 426 and a sealed initiator 440, as explained more fully above.

The flowpath 454 includes a valve 450 disposed therein. The valve 450, generally, provides a sealing engagement with the flowpath 454, thereby preventing (entirely or substantially) pressurized fluid from the cavity 446 through the flowpath 454. In some embodiments, the valve 450 may be configured as a check valve, such as, for example, a metering check valve, including a seat 456 and a stop 452. For instance, in some embodiments, the valve 450 is a spring-loaded check valve that opens or partially opens based on a relative pressure difference on an uphole side of the stop 452 and a downhole side of the seat 456 in the flowpath 454. Thus, the downhole side of the seat 456 may experience pressure $P_2$ equal to or substantially equal to a pressure of the pressurized fluid in the cavity 446. The uphole side of the stop 452 may experience a pressure $P_1$ equal to or substantially equal to a wellbore pressure, such as a pressure in the annulus 110 of wellbore 106.

In some instances, the wellbore pressure $P_1$ applied to the uphole side of the stop 452 may be related to a depth of the perforating sub in the wellbore. For instance, hydrostatic pressure in the wellbore may decrease as the perforating sub is raised to the surface. In some instances, the wellbore pressure $P_1$ applied to the uphole side of the stop 452 may be greater than the pressure $P_2$ of the pressurized fluid in cavity 446 at the depth in the wellbore in which the one or more perforating guns are discharged. Thus, the stop 452 remains in contact with the seat 456, thereby preventing (entirely or substantially) the pressurized fluids from escaping. As the perforating sub is raised to the surface (e.g., upon completion of a perforating job), wellbore pressure $P_1$ applied to the uphole side of the stop 452 decreases while the pressure $P_2$ of the pressurized fluid in the cavity remains constant or substantially constant. Once the wellbore pressure $P_1$ becomes less than the pressure $P_2$, the stop 452 may come unseated and the pressurized fluids may bleed-off in a controlled manner (e.g., slowly and in relation to the changing pressure differential $P_2-P_1$).

Figure 4:
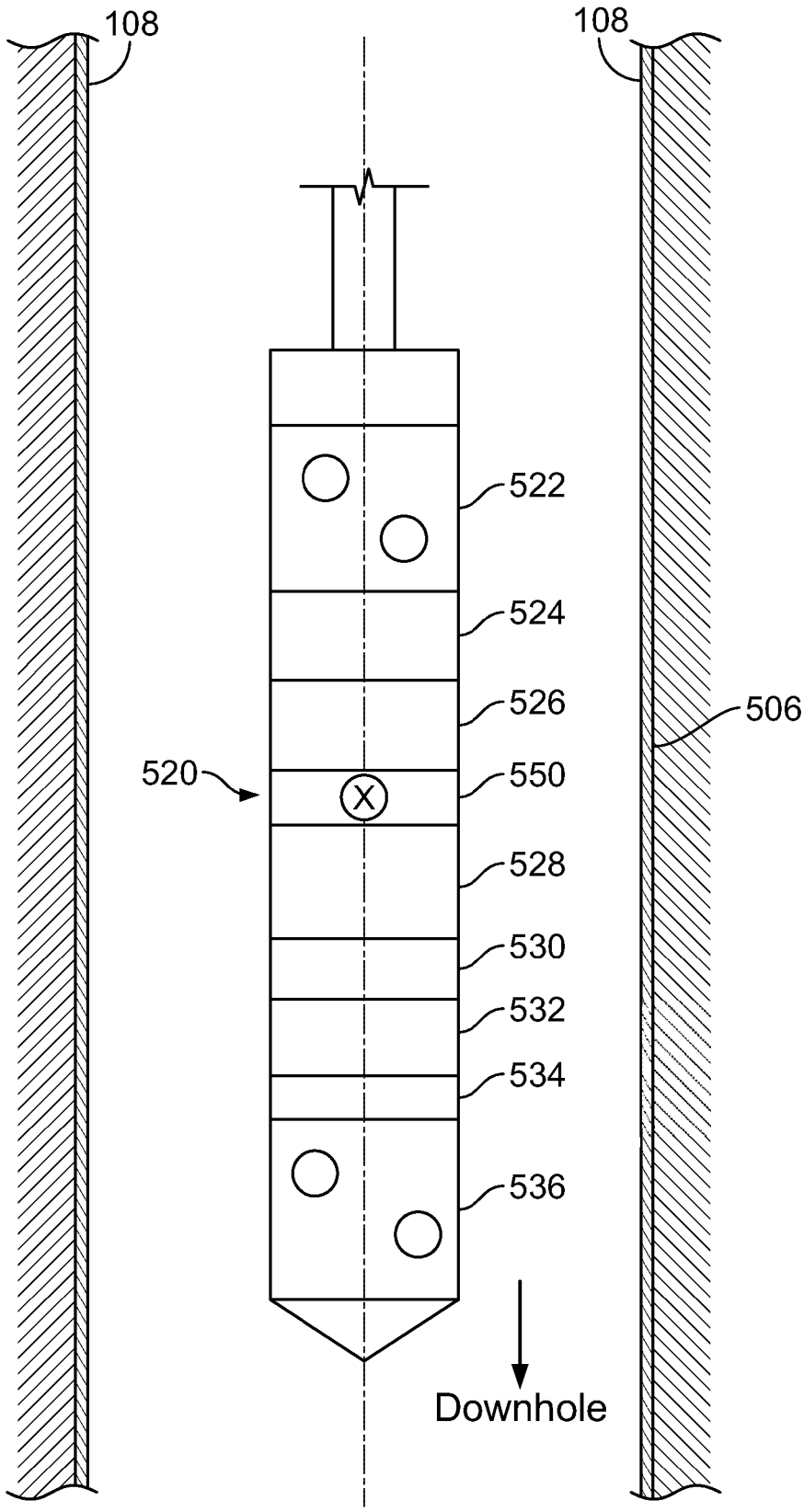
FIG. 4 illustrates another example embodiment of a perforating sub-assembly including a valve to relieve a pressurized fluid captured in the string in accordance with the present disclosure.

FIG. 4 illustrates another example embodiment of a perforating sub 520 including a valve 550 to relieve a pressurized fluid captured in the sub 520. The perforating sub 520 includes, from an uphole end to a downhole end, a perforating gun 522, a connector module 524, an isolation sub 526, the valve 550, a spacer gun 528, a connector module 530, an isolation sub 532, a tandem 534, and a perforating gun 536. Generally, the perforating guns 522 and 536, the connector modules 524 and 530, the isolation subs 526 and 532, and the spacer gun 528 are similar to are substantially similar to those same components as described with reference to FIG. 2.

The valve 550 of the illustrated embodiment in FIG. 4 is coupled between the isolation sub 526 and the spacer gun 528. As noted above, the spacer gun 528 captures the explosive gases (some or all) generated by detonating an explosive train (e.g., detonating cord) in order to discharge perforating guns 522 and 536. Although the valve 550 is illustrated as uphole of the spacer gun 528 in the perforating sub 520, the valve 550 may be located at another position in the perforating sub 520 provided that the valve 550 is in fluid communication with an interior cavity of the spacer gun 528.

In some embodiments of the perforating sub 520 shown in FIG. 4, the valve 550 may be configured as a drain valve (e.g., globe, gate, ball, or otherwise) operated (i.e., opened and/or closed) either manually or by other techniques (e.g., mechanical tool, electrically, hydraulically, or otherwise actuated tool). Thus upon removal of all or part of the perforating sub 520 from the wellbore 506, the valve 550 may be actuated to relieve the pressurized fluids contained in the spacer gun 528 to the atmosphere or ambient air. In some embodiments, actuation of the valve 550 to remove such pressurized fluids may be accomplished with no or substantially no disassembly of all or a portion of the perforating sub 520.

A number of embodiments have been described. Nevertheless, it will be understood that various modifications may be made. For example, FIGS. 3A-3B illustrate a valve (e.g., valves 350 and/or 450) disposed in a body of an isolation sub (e.g., isolation subs 326 and/or 426). Alternatively, the valve may be disposed in the body of another sub assembly besides the isolation sub assembly. For example, the valve may be disposed within and/or through a body of an sub assembly that may couple together sub assembly components of a perforating sub assembly, such as perforating sub assemblies 120 and/or 200. For instance, certain embodiments of perforating sub 200 may not include isolation subs 226 and 230. Thus, pressurized fluid (e.g., explosive gases, fluids, or a combination thereof) built up in the spacer gun 228 may be trapped (all or substantially). For instance, connector subs, such as, for example, connector modules 224 and 232 may include a bore that allows an explosive train to be disposed therethrough. Although the bore of the connector sub may not include, for example, a sealed initiator to isolate pressure on one side of sub assembly, such a bore may become plugged (e.g., through pieces of a detonated explosive train, fines, or other parts of a subterranean zone material), thereby trapping pressurized fluid on one side of the connector sub assembly. The valve disposed within and/or through the body of the connector sub assembly may allow for the relief of such pressurized fluids as described above with respect to FIGS. 1-4. Further, in other embodiments, the valve may be disposed through and/or within a body of another sub assembly component, such as, for example, a tandem. Accordingly, other embodiments are within the scope of the following claims.

What is claimed is:

1. A wellbore apparatus, comprising:

a connector sub assembly comprising a body, the body having a first end adapted to couple to a first perforating sub component and a second, axially opposed end adapted to couple to a second perforating sub component, the connector sub body defining:

a cavity proximate the second end of the connector sub body; and a flow path in fluid communication with the cavity and a location exterior to the wellbore apparatus; and a valve residing in the flow path and that is closed to fluid flow from the cavity, through the flow path, to the location exterior to the wellbore apparatus until opened in response to action by a user; and wherein at least partially decoupling the first perforating sub component from the connector sub assembly enables the valve to be opened to allow fluid flow from the cavity, through the flow path, to the location exterior to the wellbore apparatus.

2. The wellbore apparatus of claim 1, wherein the connector sub assembly comprises an isolation sub assembly, and the body comprises an isolation sub assembly body.

3. The wellbore apparatus of claim 2, wherein the body further defines a firing pin bore proximate the first end of the connector sub body, and wherein the wellbore apparatus further comprises an explosive charge receptacle between the firing pin bore and the cavity, the explosive charge receptacle adapted to sealingly receive an explosive initiator charge.

4. The wellbore apparatus of claim 1, wherein the flow path is in fluid communication with a location proximate the first end.

5. The wellbore apparatus of claim 1, wherein the flow path has an outlet on at least one of a lateral surface of the connector sub body or an end surface of the connector sub body.

6. The wellbore apparatus of claim 1, wherein the first perforating sub component comprises a perforating gun and the second perforating sub component comprises a spacer gun.

7. The wellbore apparatus of claim 6, wherein the cavity is in fluid communication with the spacer gun.

8. The wellbore apparatus of claim 1, wherein the valve is a manual valve that is manually actuatable to allow fluid flow from the cavity, through the flow path, to the location exterior to the wellbore apparatus when the wellbore apparatus is at or adjacent to a terranean surface.

9. The wellbore apparatus of claim 1, wherein the valve comprises one of a needle valve or drain valve.

10. The wellbore apparatus of claim 1, where an outlet of the flow path is covered by the first perforating sub component when the first perforating sub component is attached to the first end.

11. The wellbore apparatus of claim 1, where the valve is configured to remain closed and retain gases from detonation of one or both of the first and second perforating sub components while the wellbore apparatus is residing in a well.

12. A method for relieving a pressurized fluid from a downhole tool, the method comprising:

withdrawing at least a portion of a downhole tool through a wellbore, the downhole tool comprising a connector sub assembly comprising a body, the body having a first end coupled to a first perforating sub component and a second, axially opposed end coupled to a second perforating sub component, the connector sub body defining a cavity proximate the second end of the connector sub body, and a flow path in fluid communication with the cavity and a location exterior to the tool, and a valve residing in the flow path;

at least partially decoupling the first perforating sub component from the connector sub body thereby uncovering an outlet of the flow path; and actuating the valve to allow fluid flow from the cavity, through the flow path, to the location exterior to the tool.

13. The method of claim 12, wherein the connector sub assembly comprises an isolation sub assembly.

14. The method of claim 12, wherein actuating the valve to allow fluid flow from the cavity, through the flow path, to the location exterior to the tool comprises manually opening the valve to allow fluid flow from the cavity, through the flow path, to the location exterior to the tool.

15. A method for relieving a pressurized fluid from a downhole tool, the method comprising:

withdrawing at least a portion of a downhole tool through a wellbore, the downhole tool comprising a connector sub assembly comprising a body, the body having a first end adapted to couple to a first perforating sub component and a second, axially opposed end adapted to couple to a second perforating sub component, the connector sub body defining a cavity proximate the second end of the connector sub body, and a flow path in fluid communication with the cavity and a location exterior to the tool, and a valve residing in the flow path; and actuating the valve to allow fluid flow from the cavity, through the flow path, to the location exterior to the tool; and further comprising withdrawing the portion of the downhole tool through the wellbore to or adjacent a terranean surface, and wherein actuating the valve to allow fluid flow from the cavity, through the flow path, to the location exterior to the tool comprises:

at least partially decoupling the first perforating sub component from the connector sub body; and uncovering a flow path outlet on a lateral surface of the connector sub body by the decoupling.

16. The method of claim 15, wherein decoupling the first perforating sub component from the connector sub body comprises unthreading the first perforating sub component from the connector sub body.

* * * * *